US009561945B2

(12) United States Patent
Gruson

(10) Patent No.: US 9,561,945 B2
(45) Date of Patent: Feb. 7, 2017

(54) BOTTLING INSTALLATION INCLUDING FILLER SPOUTS FITTED WITH FEED-BACK DUCTS FROM THE SPOUT BODIES

(75) Inventor: Bertrand Gruson, Breville sur Mer (FR)

(73) Assignee: SERAC GROUP, La Ferte Bernard (FR)

( * ) Notice: Subject to any disclaimer, the term of this patent is extended or adjusted under 35 U.S.C. 154(b) by 385 days.

(21) Appl. No.: 13/540,427

(22) Filed: Jul. 2, 2012

(65) Prior Publication Data

US 2013/0000779 A1 Jan. 3, 2013

(30) Foreign Application Priority Data

Jul. 1, 2011 (FR) ..... 11 55978

(51) Int. Cl.

| | |
|---|---|
| ***B67C 3/04*** | (2006.01) |
| ***B67C 3/00*** | (2006.01) |
| ***B67C 3/22*** | (2006.01) |
| ***B67C 3/28*** | (2006.01) |

(52) U.S. Cl.

CPC ..... *B67C 3/001* (2013.01); *B67C 3/045* (2013.01); *B67C 3/22* (2013.01); *B67C 3/28* (2013.01)

(58) Field of Classification Search

CPC ..... B67C 3/22; B67C 3/26; B67C 3/001; B67C 3/045; B67C 3/28

USPC ..... 141/45, 237, 244, 290; 222/318, 424; 95/260, 261, 262

See application file for complete search history.

(56) References Cited

U.S. PATENT DOCUMENTS

| | | | | |
|---|---|---|---|---|
| 3,443,608 | A * | 5/1969 | Copping et al. | 141/46 |
| 3,580,298 | A * | 5/1971 | Trusselle | 141/40 |
| 3,918,475 | A * | 11/1975 | Trusselle | 141/128 |
| 3,993,111 | A * | 11/1976 | McLennand | 141/90 |
| 5,161,586 | A * | 11/1992 | Auriemma | 141/46 |
| 5,228,889 | A * | 7/1993 | Cortial | B01D 19/00 210/436 |
| 6,305,437 | B1 * | 10/2001 | Edwards et al. | 141/1 |
| 7,537,644 | B2 * | 5/2009 | Park et al. | 95/261 |
| 7,942,170 | B2 * | 5/2011 | Gruson | 141/45 |
| 2007/0113919 | A1 * | 5/2007 | Gruson | 141/91 |
| 2007/0205214 | A1 * | 9/2007 | Roberts | 222/58 |
| 2012/0216679 | A1 * | 8/2012 | Jonsson | A61M 1/3627 95/260 |

FOREIGN PATENT DOCUMENTS

| | | | |
|---|---|---|---|
| DE | 102007014702 | A1 | 9/2008 |
| FR | 2893605 | A1 | 5/2007 |

* cited by examiner

*Primary Examiner* — Mark A Laurenzi
*Assistant Examiner* — Andrew Stclair
(74) *Attorney, Agent, or Firm* — Muncy, Geissler, Olds & Lowe, P.C.

(57) ABSTRACT

The bottling installation for bottling a liquid in containers includes at least one filler terminal comprising a filler spout (2) comprising a spout body having a top end portion connected to a filler spout feed duct (7) and a bottom end provided with an orifice (8) fitted with a controlled valve, the filler spout being fitted with a feed-back duct (10) opening out into the spout body (6) above the controlled valve (9) and suitable for being connected by a connection member (11) to a general feed duct (12) between a stop valve (14) and an isolating valve (15), a purge valve (17) being connected to the general feed duct (12) between the isolating valve (15) and the connection member (11).

8 Claims, 2 Drawing Sheets

BOTTLING INSTALLATION INCLUDING FILLER SPOUTS FITTED WITH FEED-BACK DUCTS FROM THE SPOUT BODIES

The present invention relates to a bottling installation for bottling a product liquid in containers.

BACKGROUND OF THE INVENTION

Bottling installations for bottling a liquid are known that comprise a series of filler terminals, each comprising a filler spout and a support member for supporting a container directly below the filler spout, so as to fill the containers in succession, each with a predetermined quantity of a liquid.

In those installations, the filler spout comprises a spout body having a top end connected to a feed duct and a bottom end provided with an orifice fitted with a controlled valve.

When the installation is being started up for bottling a new product liquid, it is necessary firstly to ensure that the spout bodies are filled. In view of the structure of the filler spouts, it is necessary for that purpose to feed the filler spouts while keeping their bottom orifices open until the ducts and the spout bodies have been completely purged of the air they initially contain, i.e. until the liquid flowing through said orifices does not contain any air bubbles. The liquid flowing through the bottom orifices is collected by a collector adjacent to said orifices. In order to ensure that air bubbles have not moved up into the feed duct of the filler spouts, it is necessary to let the liquid flow for a relatively long time, during which time the installation is not used for bottling the product liquid in containers.

In addition, for reasons of compactness, the collector that is used for recovering the product liquid during initial filling of the filler spouts is generally also used for recovering the washing and rinsing liquid from the filler spouts in such a manner that it is not possible to envisage re-using the liquid that passes during initial filling of the filler spout. That liquid therefore represents a loss, not only in terms of the cost of unused product liquid, but also in terms of the additional cost of treating the liquids recovered in the collector.

In addition, there currently exist ecological concerns to limit not only losses of the product liquid, but also water consumption when cleaning the installation. Traditional installations generally include a filler tank that is connected to the filler spout in order to enable the delivery rate of the liquid to be regulated, e.g. by controlling the air pressure at the surface of the liquid. That layer of air prevents any opening and closing of the spout valves leading to variations in pressure or in the delivery rate of liquid at the outlet of the filler tank. However, washing that filler tank and its associated tubing requires large quantities of water, so that there is a trend towards reducing the size of filler tanks.

There thus exist installations for bottling a liquid in which the general feed duct is connected to the filler spouts by a connection member or diffuser mounted in the place of the filler tank.

Complete removal of air from the feed ducts, from the connection member, and from the filler spouts is performed during a preproduction stage during which the spouts are fed with the liquid, which is then poured out either into containers and then discarded, or else into a liquid recovery tray, until the bubbles have disappeared completely. A relatively large quantity of product liquid is spoiled. During production, the liquids for bottling trap air, generally in the form of bubbles, which air must be eliminated in order to improve the accuracy and the repeatability with which containers are filled, and in order to prevent overflow from the containers. In addition, a portion of that air runs the risk of accumulating in the high portions of the feed ducts, thus making operator intervention necessary during production in order to exhaust the accumulated air by operating a vent valve.

One solution to that problem has been to replace the connection member with a filler tank of reduced volume.

In filler tanks, bubbles rise easily to the surface of the liquid: the filler tanks thus facilitate the removal of gas or bubbles from the liquid and they are correspondingly more useful the greater the viscosity of the liquid. However, the question of washing the tank once again arises.

OBJECT OF THE INVENTION

An object of the invention is to provide a reliable bottling installation for bottling a product liquid in containers, making it possible to minimize both the quantity of product lost and also the amount of water consumed for washing during changes of product.

SUMMARY OF THE INVENTION

With a view to achieving this object, the invention provides a bottling installation for bottling a liquid in containers, the installation including at least one filler terminal comprising a filler spout and a support member for supporting a container directly below the filler spout, the filler spout comprising a spout body having a portion connected to a filler spout feed duct connected to a general feed duct provided with an isolating valve, and a bottom end provided with an orifice fitted with a controlled valve. The filler spout is fitted with a feed-back duct opening out into the spout body above the controlled valve and connected to a connection member connected to the general feed duct and to a main purge duct in order to selectively connect the spout to these ducts. A secondary purge duct is connected, via a secondary purge valve, to the general feed duct upstream from the isolating valve and to the main purge duct upstream from a main purge valve, and a top segment of the main purge duct is oriented in order to trap air bubbles rising up from the liquid.

Thus, during initial filling, the body of the filler spout is fed by the feed-back duct, so that the liquid flows in the same direction as the air trapped in the filler spout, and in order to purge the air initially contained in the feed ducts, the spout, and the connection member it suffices to send a quantity of product liquid into the ducts that is only very slightly greater than the volume of the ducts and of the filler spout body. This initial filling is therefore very fast and the quantity of product that is wasted is very small.

The absence of a filler tank and of associated tubing enables washing water to be limited and the purge circuit ensures a function of gas or bubble removal, thus making it possible to eliminate air from the feed ducts.

BRIEF DESCRIPTION OF THE DRAWINGS

Other characteristics and advantages of the invention appear on reading the following description of a particular, non-limiting embodiment of the invention with reference to the appended figures, in which.

DETAILED DESCRIPTION OF THE INVENTION

Figure 1:
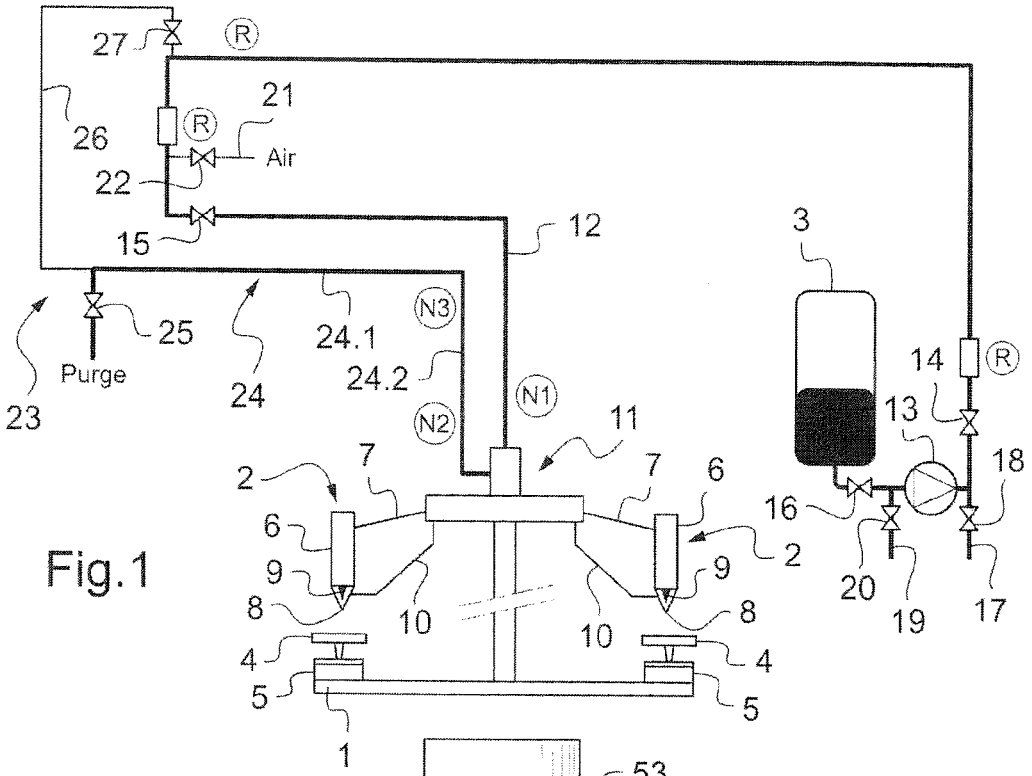
FIG. 1 is an overall diagrammatic view of an installation of the invention.

With reference to FIG. 1 and in known manner, the filler installation shown comprises a rotary carrousel comprising a rotary stand 1 carrying the filler stations, each comprising a filler spout 2 and a support member 4 for supporting a container directly below the filler spout, each support member 4 being associated with a weighing member 5 acting together with a control unit (not shown) in order to control the corresponding filler spout.

Each filler spout 2 comprises a spout body 6 having a top end connected to a feed duct 7 of the filler spout and a bottom end provided with an orifice 8 fitted with a controlled valve 9.

In the invention, each filler spout 2 is further fitted with a feed-back duct 10 having one end fastened to the spout body 6 and opening out into the body of the spout above the valve 9, and an opposite end connected to a multi-channel connection member 11, or diffuser, the structure of which is described below with reference to FIG. 2. The multi-channel connection member 11 is connected firstly to a general feed duct 12 that is itself connected to a feed tank 3 via a pump 13 mounted in the vicinity of said feed tank. An isolating valve 16 is mounted between the pump 13 and the feed tank 3 in order to isolate the feed tank from the pump 13. The general feed duct 12 is fitted with a stop valve 14 and with an isolating valve 15 mounted between the stop valve 14 and the multi-channel connection member 11.

An effluent removal duct 17 is connected via a valve 18 to the general feed duct 12 between the pump 13 and the stop valve 14.

A washing water duct 19 is connected via a valve 20 to the general feed duct 12 upstream from the pump 13 and downstream from the isolating valve 16 of the feed tank 3 relative to the general feed duct 12. A pressurized air feed duct 21 is also connected to the general feed duct 12 via a valve 22 connected to the general feed duct 12 upstream from the isolating valve 15.

The installation includes a purge circuit generally given the reference 23 comprising a main purge duct 24 that is connected to the multi-channel connection member 11 and fitted with a purge valve 25 that is connected to the purge duct 24 by a T-connection having a branch opposite from its connection to the purge duct 24 that is connected to one end of a secondary purge duct 26 having an opposite end that is connected via a secondary purge valve 27 in the high portion of the general feed duct 12 upstream from the isolating valve 15. The secondary purge duct 26 has a flow section that is smaller than the flow section of the main purge duct 24.

The main purge duct 24 includes a top segment 24.1 that is oriented so as to trap air bubbles rising up from the liquid. Said top segment 24.1 is connected to the connection member 11 by a vertical segment 24.2. The top segment 24.1 is in this example very slightly inclined relative to the horizontal towards the vertical segment 24.2, i.e. the end of the top segment 24.1 connected to the secondary purge duct 26 is above the end of the top segment 24.1 that is connected to the vertical segment 24.2.

Two liquid presence sensors N2 and N3 are mounted on the vertical segment 24.1 to measure the presence in the main purge duct 24 of a quantity of liquid, and the main purge valve 25 is controlled as a function of said quantity.

A liquid presence sensor N1 is mounted on the main feed duct 12 in the vicinity of the connection member 11.

Figure 2:
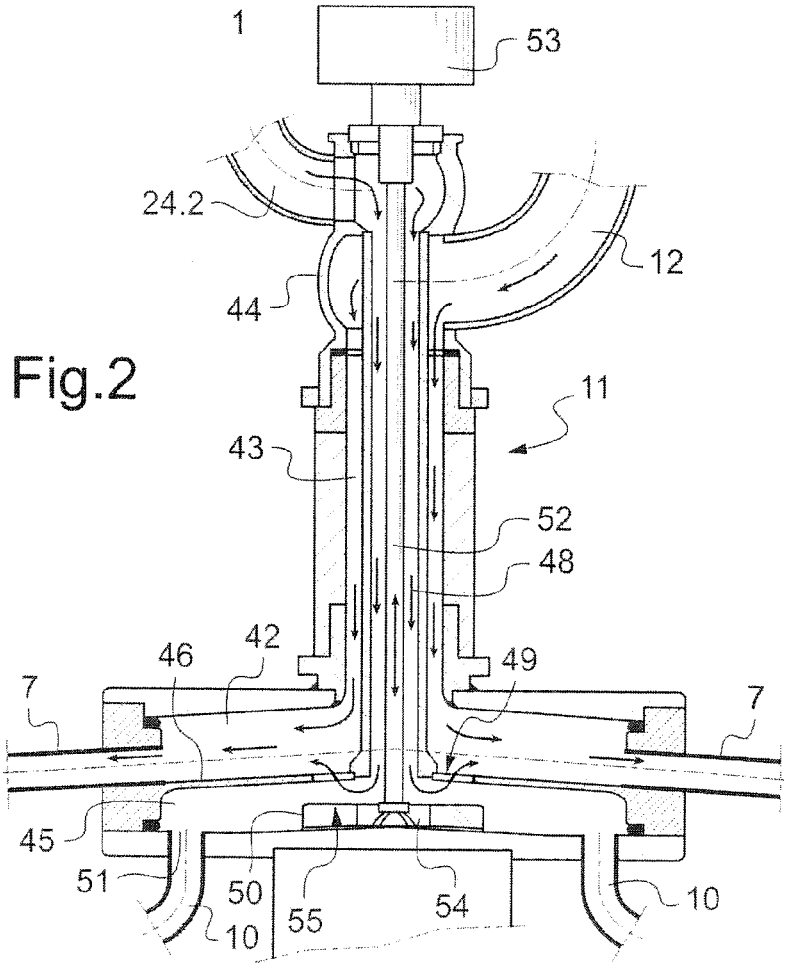
FIG. 2 is a diagram in axial section along a vertical plane of a connection member mounted in said installation, in a production configuration.
Figure 3:
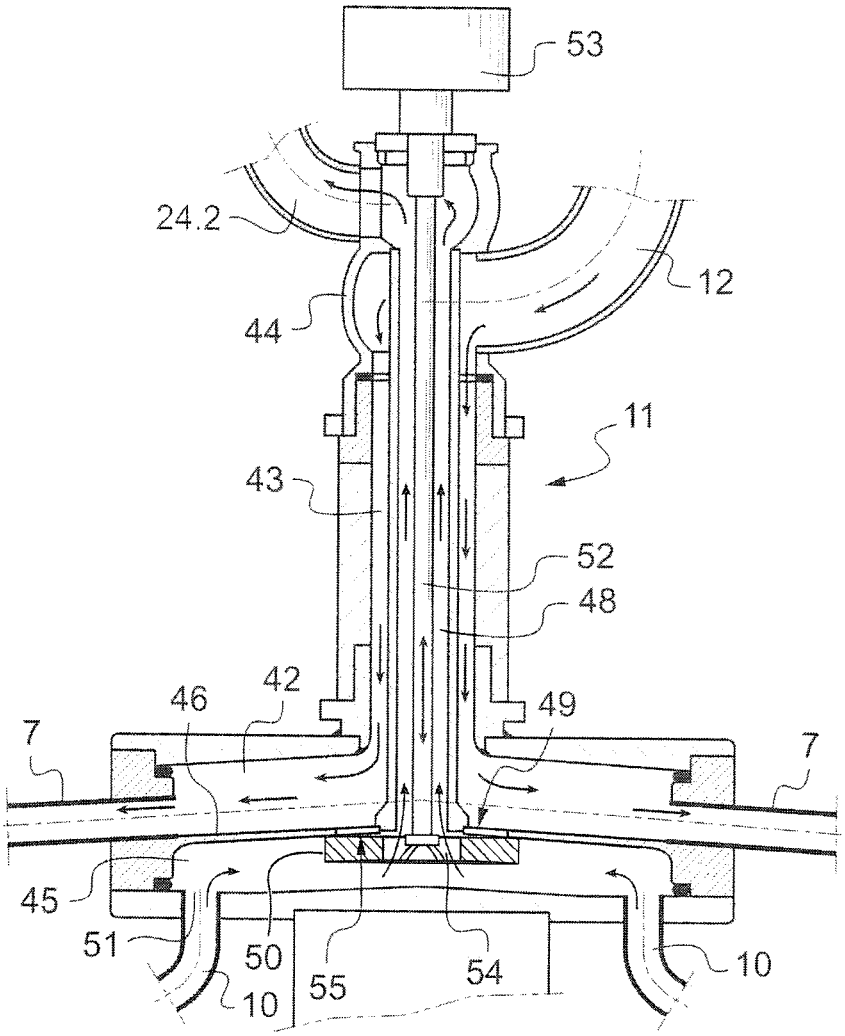
FIG. 3 is a diagram in axial section along a vertical plane of said connection member in a feed-back configuration.

With reference to FIG. 2 and in known manner, the multi-channel connection member 11 comprises a first circular chamber 42 to which there are connected the feed ducts 7 of the filler spouts 2 of the various filler terminals that are distributed regularly about an axis of symmetry of the multi-channel connection member 11. Also in known manner, the first chamber 42 is connected by a first connection duct 43 to the general feed duct 12 via a rotary coupling 44.

In the invention, the connection member further comprises a second chamber 45 that is coaxial with the first chamber 42 and extends under the first chamber while being separated therefrom by an intermediate partition 46. A second duct 48 is fastened to the intermediate partition 46 and extends on the same axis as the first duct 43 inside said duct. The bottom end of the duct 48 is fastened to the intermediate partition 46 by radial arms defining about the duct 48 an opening 49 through the intermediate partition 46. The top end of the duct 48 is connected to the inside of the rotary coupling 44 in order to ensure a connection with the vertical segment 24.2 of the main purge duct 24 of the purge circuit 23. The feed-back ducts 10 of the various filler spouts open out into the bottom wall of the second chamber 45. A distribution member in the shape of a circular plate 50 is mounted in the second chamber 45 coaxially therewith. The position of the distribution member 50 in the second chamber 45 is determined by a control rod 52 having a top end that is connected to a control member 53 and having a bottom end that is connected to the distribution member by radial arms defining an opening 54 through the distribution member facing the bottom end of the second duct 48. The top face of the distribution member 50 comprises an annular surface 55 closing the opening 49 in leaktight manner when the distribution member 50 is in the high position, applied against the intermediate wall 46.

When the installation is started up, the circuit of the installation is filled with air. All of the valves are closed.

The plate 50 is in the high position thus ensuring a "feed-back" configuration that serves to convert the automatic filling machine into an extension of the general feed duct 12 and connects in series:

the general feed duct 12;
the central feed tube 43 of the connection member 11;
the low portion 45 of the connection member 11;
the feed-back ducts 10;
the measuring spouts 2;
the feed ducts 7;
the high portion 42 of the connection member 11;
and
the purge circuit 23.

The "feed-back" configuration is used during stages of purging air at the start of production or during washing.

From this position, the air contained in the circuit of the installation is purged. The isolating valves 16, 15, the stop valve 14 and the main purge valve 25 are opened and the pump 13 is activated in order to allow liquid under pressure into the feed circuits and to purge said circuits of air, until the liquid reaches the sensor N3. Air is exhausted via the main purge valve 25 but some of the air is retained in the top segment 24.1.

When the liquid reaches the sensor N3 at a level corresponding to the total volume of the filler spout bodies 6 plus the filler spout feed ducts 7, the stop valve 14 is closed.

In production, the plate 50 is brought into the low position and the stop valve 14 is opened.

The secondary purge valve 27 is thus open, and that has the effect of sending liquid that is heavily loaded with air (since it has been taken from a high portion of the general feed duct 12), at a slow delivery rate into the top segment 24.1 of the main purge duct 24. Since the top segment 24.1 is practically horizontal, and since the delivery rate is low, the layer of liquid is of small thickness thereby promoting the rising of bubbles to the surface so that the top segment 24.1 plays the role of a "bubble remover" by creating a separation between said bubbles that remain on the surface of the liquid and the liquid that is moving back down towards the connection member 11. The low delivery rate of liquid in the secondary purge duct 26 relative to the flow rate of the main purge duct 24 is obtained by correctly dimensioning the sections of these two ducts. In a variant, it is also possible to control the flow section of the secondary purge valve 27.

As the bubbles accumulate in the main purge duct 24, the level of liquid in the vertical segment 24.1 of the main purge duct 24 moves progressively downwards. When said level of liquid reaches the sensor N2, the main purge valve 25 is controlled to open, and that makes it possible to progressively exhaust the excess air contained in the main purge duct 24. The main purge valve 25 is controlled so as to close when the liquid moves up to the sensor N3. There is therefore no waste of product liquid associated with this method of purging the air contained in the liquid.

This configuration with a feed duct in series with a purge duct containing air offers the advantage of significantly improving measuring accuracy, in particular with technology for filling by weight. As mentioned above, the presence of air in the main purge duct 24, makes it possible to absorb the variations in pressure associated with the opening and closing of spouts, and that makes it possible to have a measuring rate that is relatively stable.

While the liquid is being bottled in the containers, the delivery rate in the feed ducts 7 of the filler spouts 2 may be firstly adjusted by the degree of opening of the isolating valve 15 and also by the air pressure in the top segment 24.1 of the main purge duct 24. The variation of the total delivery rate in the pipes 7 of the filler spouts is compensated for by a variation in the liquid level in the vertical segment 24.2 of the main purge duct 24 in such a manner that the delivery rate is substantially constant in each of the feed ducts 7 of the filler spouts 2.

When it is desired to change the product liquid, the isolating valve 16 of the feed tank 3 is closed and a scraper or "pig" is inserted into the general feed duct. The valve 20 of the washing circuit 19 is opened so that the washing water pushes the pig, which pig then pushes the liquid in such a manner that a number of containers corresponding substantially to the volume of liquid contained in the circuit of the installation are filled using the filler spouts in conventional manner. The secondary purge valve 27 is closed before the pig moves through it and the isolating valve 15 is closed when the pig reaches its arrival station.

The connection member 11 is then controlled into a high position so as to put the circuit into a feed back loop configuration. Washing is then carried out in conventional manner by placing a collector under the spouts 2 and under the main purge valve 25 in order to recover the washing water.

Pressurized air is sent into the general feed duct 12 so as to empty the washing water from the circuit of the installation and to dry it.

Rinsing and purging of the installation may be carried out under the same conditions as washing. The installation is thus ready to bottle a new product liquid transported in known manner from a feed tank connected in parallel to the stop valve 14 via appropriate separation valves in order to avoid communication between the feed tanks.

Naturally, the invention is not limited to the above-described embodiments and variants may be applied thereto without going beyond the ambit of the invention, as defined by the claims.

In particular, although the installation is described relative to measuring by weight and supporting the containers by their bases, the invention also applies to filler spouts associated with containers supported by their the necks and/or devices for measuring by flow measurement.

Although the implementation of an accumulation channel is described relative to the multi-channel connection member of the invention that makes it possible to feed a series of filler spouts simultaneously, the invention may also be implemented on a single filler spout associated with a set of simple valves associated with a network of ducts that are appropriately connected together.

In a variant, the distribution member 50 may include lugs projecting from its bottom face that extend facing each of the feed-back ducts 10 in order to close said ducts during production operations.

The main purge valve may be replaced by two valves: a valve of higher delivery rate for purging the circuit outside of production and a valve of lower delivery rate for regulating the air pressure in the top segment during production.

In a variant, the washing circuit may be connected to the purge duct upstream and next to the main purge valve 25. However, this solution consumes more washing water.

The invention claimed is:

1. A bottling installation for bottling a liquid in containers, the installation including at least one filler terminal comprising a filler spout (2) and a support member (4) for supporting a container directly below the filler spout, the filler spout comprising a spout body (6) having a portion connected to a filler spout feed duct (7) and a bottom end provided with an orifice (8) fitted with a controlled valve (9), a general feed duct (12) connected to said filler spout feed duct and provided with an isolating valve, wherein:

the filler spout (2) is fitted with a feed-back duct (10) opening out into the spout body (6) above the controlled valve (9), the feed-back duct is connected to a connection member (11) and the connection member is connected to the general feed duct (12) and to a main purge duct (24) in order to selectively connect these ducts in a feed-back configuration and a production configuration, a secondary purge duct is connected, via a secondary purge valve, to the general feed duct upstream from the isolating valve and to the main purge duct upstream from a main purge valve, the main purge duct includes a top segment and a vertical segment between the top segment and the connection member, the top segment having a first end connected to the vertical segment and a second end which is at a level above the first end and is connected to the secondary purge duct so that the top segment of the main purge duct is oriented in order to trap air bubbles rising up from the liquid, and the entirety of the top segment is an inclined pipe extending from the vertical segment to the secondary purge duct.

2. An installation according to claim 1, wherein the connection member is arranged to have a first connection state corresponding to the production configuration in which the spout feed duct and the feed-back duct are simultaneously connected to the general feed duct, and a second connection state corresponding to the feed-back configuration in which the feed-back duct is connected to the main purge duct (24), and the filler spout feed duct is connected to the general feed duct.

3. An installation according to claim 2, wherein the connection member (11) is a multi-channel member having a channel connected to the filler spout feed duct (7), a channel connected to the feed-back duct (10), a channel connected to the general feed duct (12), and a distribution member (50) arranged to authorize feeding of the filler spout feed duct (7) and the feed-back duct (10) that are in a parallel or feed-back loop connection.

4. An installation according to claim 3, characterized in that the multi-channel connection member (11) comprises a first duct (43) connected to the general feed duct (12) and opening out to a first chamber (42) to which the feed duct (7) of the filler spout is connected, a second duct (48) connected to the main purge duct (24) and opening out into a second chamber (45) separated from the first chamber (42) by an intermediate partition (46) comprising a communication orifice (49) and to which the feed-back duct (10) is connected, and a distribution member (50) mounted to move in the second chamber between a position corresponding to the production configuration in which the general feed duct is connected to the feed-back duct through the communication orifice and a position corresponding to the feed-back configuration in which the distribution member closes the communication orifice, the distribution member (50) being perforated by an opening (54) facing the second duct (48).

5. An installation according to claim 1, including liquid presence sensors (N2, N3) for measuring the presence in the purge duct of a quantity of liquid, and wherein the main purge valve is controlled as a function of said quantity.

6. An installation according to claim 1, comprising a plurality of filler terminals having feed ducts (7) of the filler spouts and feed-back ducts (10) connected to a shared connection member (11).

7. An installation according to claim 6, characterized in that the feed ducts (7) of the filler spouts and the feed-back ducts (10) are distributed regularly about an axis of symmetry of the connection member.

8. An installation according to claim 4, including a washing circuit (19, 20) that is connected to the general feed duct (12).

* * * * *